US007841038B2

(12) United States Patent
Vosbikian

(10) Patent No.: US 7,841,038 B2
(45) Date of Patent: Nov. 30, 2010

(54) COMBINATION MANUAL HAND TOOL

(76) Inventor: Samuel G. Vosbikian, 2 Olde Mill Run, Medford, NJ (US) 08055

( * ) Notice: Subject to any disclaimer, the term of this patent is extended or adjusted under 35 U.S.C. 154(b) by 485 days.

(21) Appl. No.: 12/006,504

(22) Filed: Jan. 3, 2008

(65) Prior Publication Data

US 2009/0172903 A1 Jul. 9, 2009

(51) Int. Cl.
*A46B 5/00* (2006.01)

(52) U.S. Cl. ..... 15/106; 15/172

(58) Field of Classification Search ..... 15/106, 15/172, 119.2, 119, 118, 228, 116.1, 116.2, 15/107, 111, 114, 117, 119.1, 105
See application file for complete search history.

(56) References Cited

U.S. PATENT DOCUMENTS 665,632 A * 1/1901 Finiels ..... 15/105
6,260,226 B1 * 7/2001 Specht ..... 15/119.1
6,588,045 B2 * 7/2003 Fernandez ..... 15/119.2

* cited by examiner

*Primary Examiner*—Shay L Karls
(74) *Attorney, Agent, or Firm*—Stuart M. Goldstein

(57) ABSTRACT

A manual hand tool has an elongated handle pivotably connected to a cleaning head. The cleaning head pivots substantially ninety degrees in relation to the handle. A first cleaning member component, e.g. a pushbroom, extends from the front section of the cleaning head and a second cleaning component, e.g. a straightbroom, extends from the rear section of the cleaning head, at about a ninety degree angle to the first cleaning component. The cleaning head is pivotable ninety degrees from a first position allowing for the use of the first cleaning member component on soiled surfaces, to a second position, allowing for the use of the second cleaning member component on soiled surfaces. Locking systems are provided to secure the handle and cleaning head in position.

25 Claims, 4 Drawing Sheets

COMBINATION MANUAL HAND TOOL

BACKGROUND OF THE INVENTION

Performing manual cleaning jobs often requires the use of more than one cleaning tool in order to complete the work effectively and efficiently. For example, when sweeping off a surface on which there is loose dirt and debris, a pushbroom may be the best option for gathering the dirt on flat floors, while a straightbroom is best for collecting dirt from the corners. A sponge mop may be needed for cleaning a floor surface after a broom is used to collect loose crumbs and other dirt. A rake may be needed for removing dirt or leaves in the yard, but a pushbroom is the best option for sweeping the sidewalk surrounding the yard.

There are very few manual hand tools which provide dual cleaning member components on the same tool and none which allow efficient, effective and immediate changeover from one cleaning member to another.

SUMMARY OF THE INVENTION

It is thus an object of the present invention to overcome the limitations and disadvantages of prior manual hand tools.

It is an object of the present invention to provide a manual hand tool which provides the user with the versatility and convenience of multiple cleaning member components on one tool.

It is another object of the present invention to provide a manual hand tool which provides the user with the option of using more than one cleaning member component when doing a cleaning job.

It is still another object of the present invention to provide a manual hand tool which allows a fast and efficient changeover from the use of one cleaning member component on the hand tool, to another cleaning member component on the same tool.

These and other objects are accomplished by the present invention, a manual hand tool with an elongated handle pivotably connected to a cleaning head. The cleaning head pivots substantially ninety degrees in relation to the handle. A first cleaning member component, e.g. a pushbroom, extends from the front section of the cleaning head and a second cleaning component, e.g. a straightbroom, extends from the rear section of the cleaning head, at about a ninety degree angle to the first cleaning component. The cleaning head is pivotable ninety degrees from a first position allowing for the use of the first cleaning member component on soiled surfaces, to a second position, allowing for the use of the second cleaning member component on soiled surfaces. Locking systems are provided to secure the handle and cleaning head in position.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
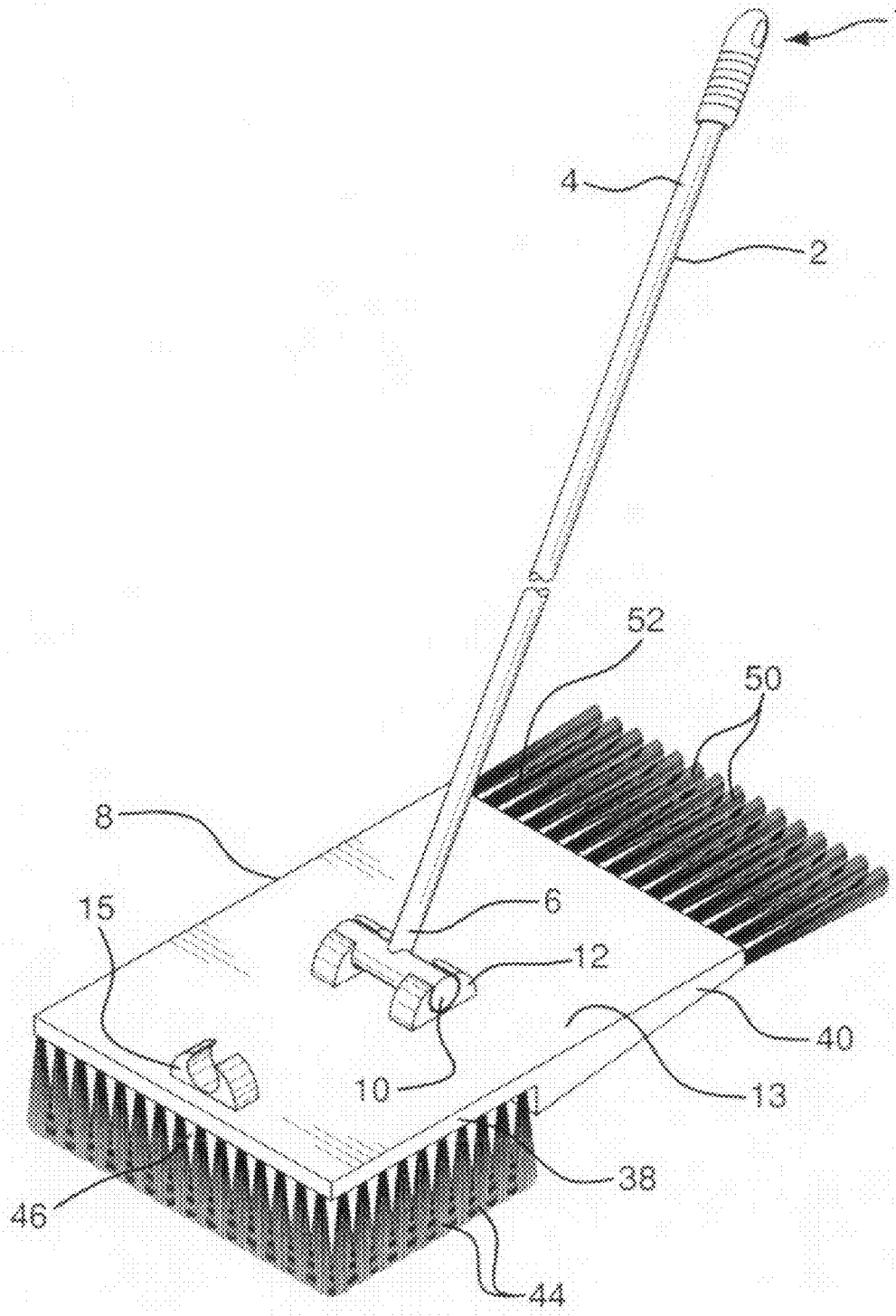
FIG. 1 is an isometric view of one embodiment of the present invention in pushbroom cleaning mode.

Manual hand tool 1 comprises elongated handle 2 with longitudinal axis 3 and upper end 4 and lower end 6. Handle 2 is pivotably connected to cleaning head 8 via pin 10 rotatable within cradle 12 located on upper surface 13 of the cleaning head. The pivotably rotatable connection between handle 2 and cleaning head 8 is not to be considered restricted to the connection described herein. It is contemplated that other equivalent connection means can be employed to ensure that the cleaning head is freely pivotable about the handle.

Cleaning head 8 has front section 38, rear section 40 and a longitudinal axis 30 extending therethrough. A set of pushbroom type bristles 44 extend from front section 38 of cleaning head 8, forming pushbroom component 46. A cleaning surface is located at the end of each bristle 44. The totality of all the cleaning surfaces serve to form cleaning surface plane 48 of pushbroom component 46. This plane is substantially parallel to longitudinal axis 30 of cleaning head 8.

A set of straightbroom type bristles 50 extend from rear section 40 of cleaning head 8, forming straightbroom component 52. Straightbroom component 52 extends at an angle, e.g. ninety degrees, in relation to pushbroom component 46. A cleaning surface is located at the end of each bristle 50. The totality of all the cleaning surfaces serve to form cleaning surface plane 54 of straightbroom component 52. This plane is substantially perpendicular to longitudinal axis 30 of cleaning head 8.

Figure 2:
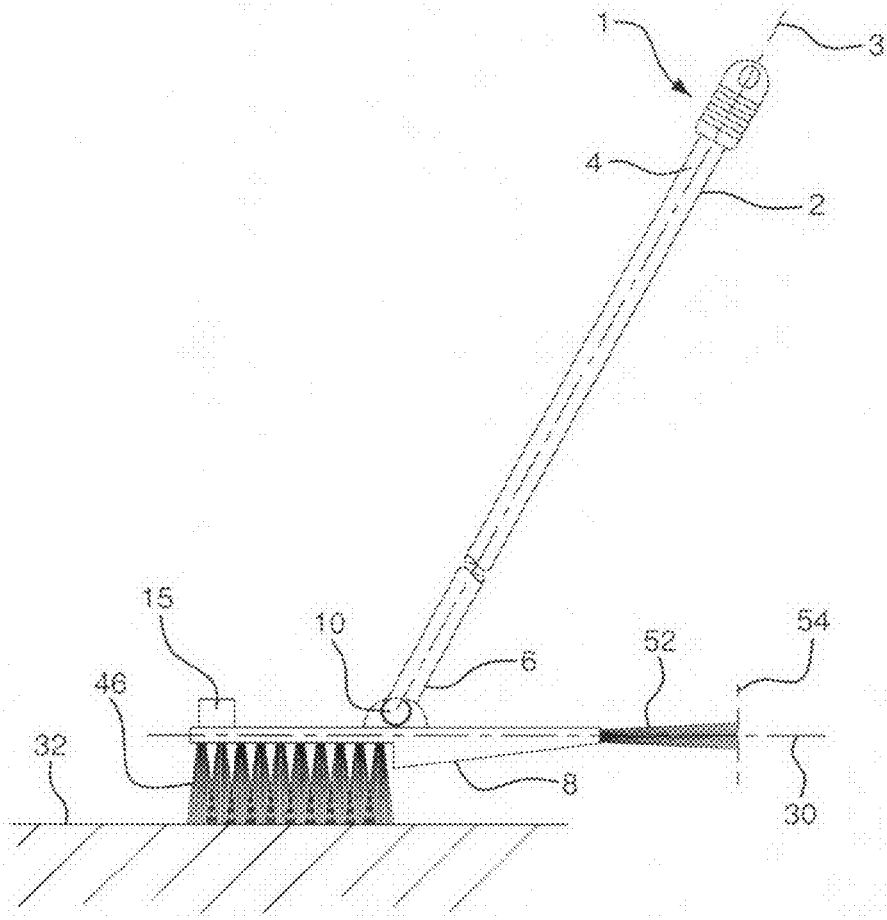
FIG. 2 is an elevation view of the embodiment of the invention shown in FIG. 1.

FIGS. 1 and 2 show manual tool 1 in pushbroom mode, with pushbroom component 46 on soiled surface 32 and straightbroom component 52 extending rearwardly of the tool at an angle of approximately 90° in relation to the pushbroom component. In this pushbroom mode configuration, cleaning surface plane 48 is, of course, substantially parallel to soiled surface 32. Cleaning surface plane 54 of straightbroom component 52 is substantially perpendicular to surface 32. Longitudinal axis 33 of handle 2 is positioned at an angle to cleaning head axis 30, surface 32, and cleaning surface plane 54. Longitudinal axis 30 is substantially parallel to surface 32.

Figure 3:
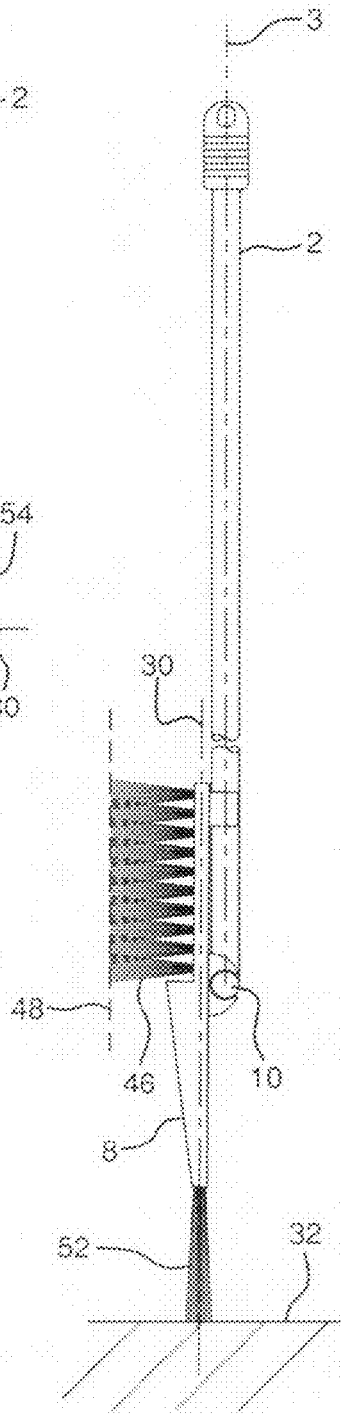
FIG. 3 is an elevation view of the embodiment of the invention shown in FIG. 1 in straightbroom cleaning mode.

FIG. 3 shows manual tool 1 in straightbroom mode, with straightbroom component 52 on soiled surface 32 and pushbroom component 46 located above the straightbroom component. In this straightbroom mode configuration, cleaning surface plane 54 is, of course, substantially parallel to soiled surface 32. Cleaning surface plane 48 is substantially perpendicular to surface 32. Longitudinal axis 30 of cleaning head 8 is substantially parallel to handle axis 3 and substantially perpendicular to surface 32. Handle 2 is locked in straightbroom mode by use of resilient locking clip 15 mounted on cleaning head 8. Rotation of handle 2 forward, towards pushbroom 46, into clip 15, will result in the handle being retained in that position, to allow use of straightbroom 52.

As an alternative to the embodiment discussed with regard to FIGS. 1-3, a spring loaded, lever rod locking system is contemplated. Lever rod 14 comprises extension spring 16 and the rod itself extends from handle grip 18 to connection point 20 on cleaning head 8. Handle grip 18 is cylindrical in shape, circumscribes and is slideably mounted on handle 2.

Handle grip 18 has through opening 22 for receiving spring loaded tabs 24 and 26, extending outwardly from handle 2, near its upper end 4. The configuration of spring loaded tabs 24 and 26, inset within handle 2 is well known. Such a design permits the tabs to be pushed inward towards the handle and, when the pushing force is released, the spring action loading the tabs compels them outward once again.

It thus can be seen that when tab 24 is located within opening 22 of handle grip 18, the handle grip is locked in position on handle 2, as is lever rod 14. In this configuration, cleaning head 8 is also locked in the position shown in FIGS. 4 and 5, with longitudinal axis 30 of the head extending substantially parallel with cleaning surface 32. When tab 24 is pushed inward, handle grip 18 is released from its locked position, allowing the handle grip to be slid upward on handle 2 over tab 26. This upward movement causes lever rod 14 to rotatably pivot cleaning head 8 substantially 900 downward around pin 10. When opening 22 of handle grip 18 moves up on handle 8 such that the opening travels over spring-loaded tab 26, the tab is compelled outward and into the opening, locking the handle grip in the position shown in FIG. 6, with longitudinal axis 30 of cleaning head 8 extending substantially perpendicular to cleaning surface 32. Sliding handle grip 18 back down handle 2, so as to again position tab 24 within opening 22, returns rotates cleaning head 8 substantially 90° to its FIGS. 4 and 5 position.

Figure 4:
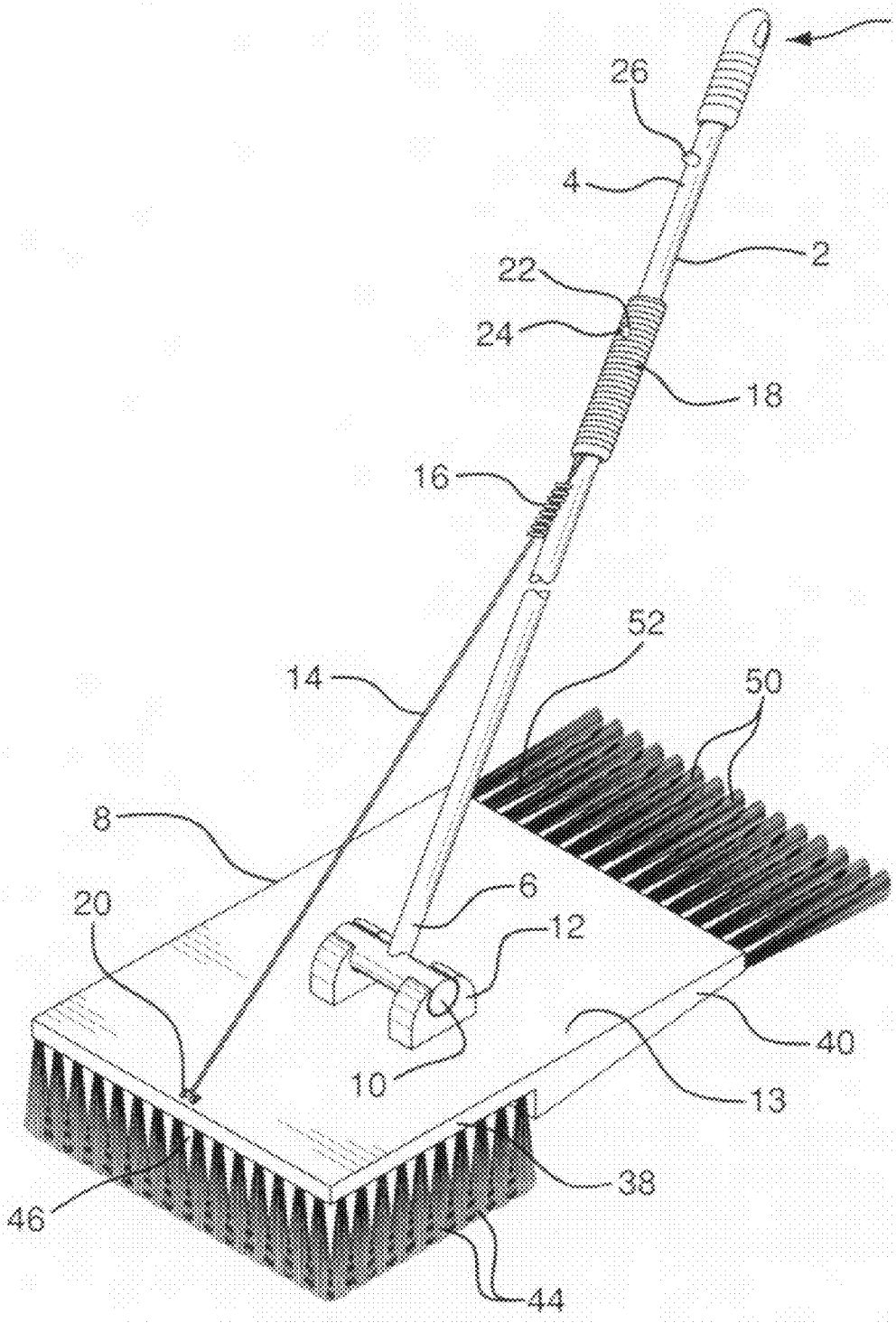
FIG. 4 is an isometric view of a second embodiment of the present invention in pushbroom cleaning mode.
Figure 5:
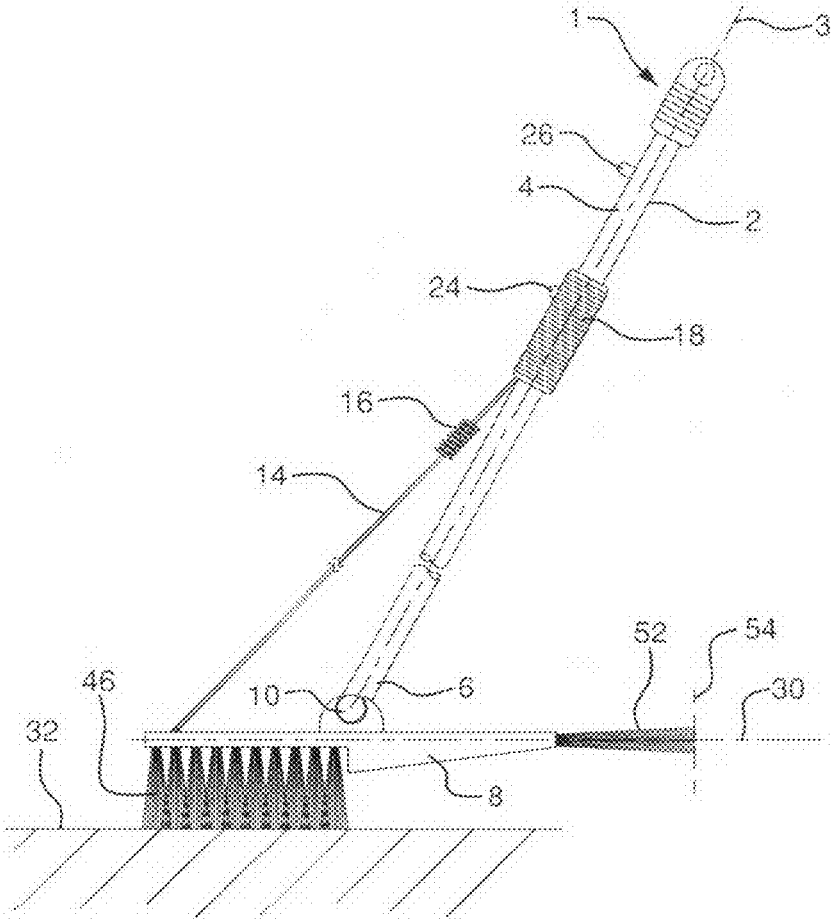
FIG. 5 is an elevation view of the embodiment of the invention shown in FIG. 4.

When manual tool is in the position shown in FIGS. 4 and 5, tab 24 in opening 22 of handle grip 18, the tool is in the pushbroom mode, as previously described with regard to FIGS. 1-3.

Figure 6:
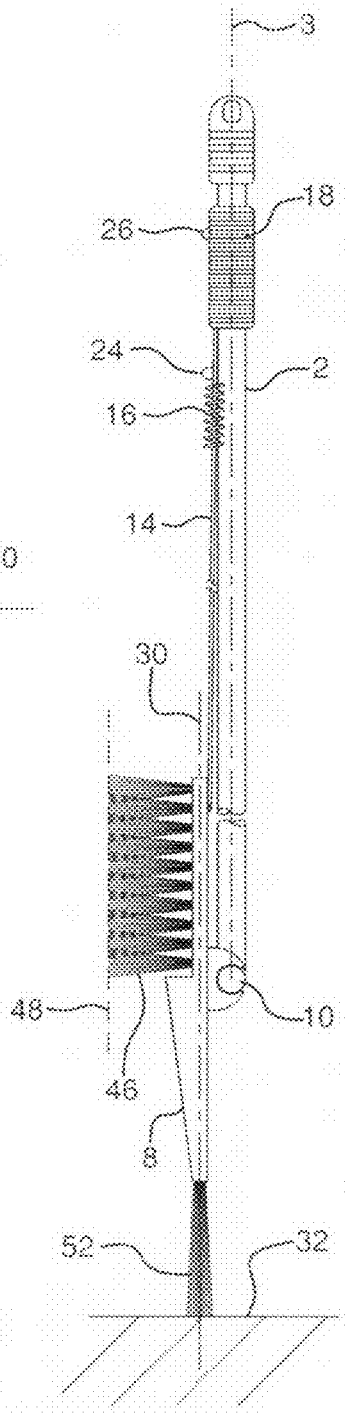
FIG. 6 is an elevation view of the embodiment of the invention shown in FIG. 4 in straightbroom cleaning mode.

When manual tool is in the position shown in FIG. 6, with handle grip 18 slid up handle 8 so that tab 26 is in opening 22 of the handle grip, the tool is locked in the straightbroom mode, as previously described with regard to FIG. 4.

It is anticipated that pin 10 to cradle 12 connection would be tight enough and provide sufficient resistance to allow pivotable movement of handle 2 in relation to cleaning head 8, yet still maintain tool 1 in its pushbroom mode and especially in its straightbroom mode during use. The connection should have enough resistance so as to prevent straightbroom component 52 from freely kicking up while being used.

While two different cleaning head locking systems are disclosed herein, it is contemplated that other systems could be used to ensure that cleaning head 8 is maintained in its pushbroom and straightbroom modes. For instance, the externally placed lever rod locking system could be positioned within handle 2 to operate and lock cleaning head 8 in position.

Although manual tool 1 has been disclosed and described with pushbroom 46 and straightbroom 52 as the two cleaning members, it is contemplated as being within the scope of the invention, that other, different cleaning devices can be employed to provide additional versatility to the inventive concept. For instance, a pushbroom component can be used with a forked like component, e.g. a rake or pitchfork, or a straightbroom component can be used with such components. Other cleaning member components which can be used in combination with the broom components or interchangeably with other cleaning member components are sponge mops, dust mops, swab mops, or shovels of varied configurations. While particular combinations of cleaning member components are disclosed herein, the invention should not be restricted to these combinations or cleaning member components. The scope of this invention extends to the use of any readily adaptable combination of cleaning member components.

It is further contemplated that cleaning attachments, such as scrapers, squeegees and abrasive scrubbers could be attached to cleaning head 8 to provide additional cleaning capabilities.

Cleaning member components can also be manufactured so that they are replaceable. If a component wears out or is no longer effective, detachment and attachment means can be provided to allow removal from and replacement on the cleaning head.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A manual hand tool comprising:

a cleaning head with a front section at one end and a rear section at the other end;

first primary cleaning means extending exclusively from the front section at the one end of the cleaning head for cleaning soiled surfaces;

second primary cleaning means extending exclusively from the rear section at said other end of the cleaning head for cleaning soiled surfaces, said primary second cleaning means extending at an angle in relation to the first primary cleaning means;

an elongated handle having an upper end and a lower end; and means pivotably connecting the lower end of the handle to the cleaning head, the cleaning head being pivotable about an angle in relation to the handle from a first position to allow the first primary cleaning means to be used on soiled surfaces, to a second position to allow the second primary cleaning means to be used on soiled surfaces, said pivotable means being positioned on the cleaning head between the first and second primary cleaning means and at a location entirely behind the first primary cleaning means when the cleaning head is in the first position, and at a location entirely in front of the first primary cleaning means when the cleaning head is in the second position.

2. The manual hand tool as in claim 1 wherein the cleaning head is pivotable substantially ninety degrees about the handle, whereby when the cleaning head is in the first position, the first primary cleaning means extends down from the cleaning head and the second primary cleaning means extends rearward of the cleaning head, and when the cleaning head is in the second position, the second primary cleaning means extends down from the cleaning head and the first primary cleaning means is located above the second cleaning means.

3. The manual hand tool as in claim 1 wherein the angle between the first and second primary cleaning means is substantially ninety degrees.

4. The manual hand tool as in claim 1 further comprising locking means to secure the handle in relation to the cleaning head.

5. The manual hand tool as in claim 4 wherein the locking means comprises a handle controlled lever mounted between the upper end of the handle and the cleaning head.

6. The manual hand tool as in claim 4 wherein the locking means comprises a cleaning head mounted clip.

7. The manual hand tool as in claim 1 wherein the pivotable means comprises a cradle mounted rotatable pin system.

8. The manual hand tool as in claim 1 wherein the first primary cleaning means is a first set of pushbroom bristles and the second primary cleaning means is a second set of straightbroom bristles.

9. A manual hand tool comprising:

a cleaning head having a longitudinally extending axis and a front section and a rear section;

a handle with an elongated longitudinal axis and an upper end and a lower end;

a first primary cleaning member having a cleaning surface plane;

a second primary cleaning member having a cleaning surface plane; and means pivotably connecting the lower end of the handle to the cleaning head, the cleaning head being pivotable about an angle in relation to the handle from a first position to a second position, said pivotable means being positioned on the cleaning head between the first and second primary cleaning member and at a location entirely behind the first primary cleaning member when the cleaning head is in the first position, and at a location entirely in front of the first primary cleaning member when the cleaning head is in the second position, whereby when the cleaning head is in the first position, the longitudinal axis of the handle is positioned at an angle in relation to the longitudinal axis of the cleaning head and in relation to the cleaning surface plane of the second primary cleaning member, and when the cleaning head is in the second position, the longitudinal axis of the handle is substantially parallel to the longitudinal axis of the cleaning head, and the cleaning surface plane of the second primary cleaning member is perpendicular to the longitudinal axis of the handle.

10. The manual tool as in claim 9 wherein the cleaning head is pivotable substantially ninety degrees about the handle, whereby when the cleaning head is in the first primary position, the first cleaning member extends down from the cleaning head and the second primary cleaning member extends rearward of the cleaning head, and when the cleaning head is in the second position, the second primary cleaning member extends down from the cleaning head and the first primary cleaning member is located above the second primary cleaning member.

11. The manual hand tool as in claim 9 wherein the angle between the first and second primary cleaning members is substantially ninety degrees.

12. The manual hand tool as in claim 9 further comprising locking means to secure the handle in relation to the cleaning head.

13. The manual hand tool as in claim 12 wherein the locking means comprises a handle controlled lever mounted between the upper end of the handle and the cleaning head.

14. The manual hand tool as in claim 12 wherein the locking means comprises a cleaning head mounted clip.

15. The manual hand tool as in claim 9 wherein the pivotable means comprises a cradle mounted rotatable pin system.

16. The manual hand tool as in claim 9 wherein the longitudinal axis of the cleaning head is substantially parallel to the cleaning surface plane of the first primary cleaning member and substantially perpendicular to the cleaning surface plane of the second primary cleaning member in both the first and second positions.

17. A manual hand tool comprising:

a cleaning head having a longitudinally extending axis;

first primary cleaning means for the removal of dirt from a surface;

second primary cleaning means for the removal of dirt from the surface;

an elongated handle having an upper end and a lower end; and means pivotably connecting the lower end of the handle to the cleaning head, the cleaning head being pivotable about an angle in relation to the handle from a first position to a second position, said pivotable means being positioned on the cleaning head between the first and second primary cleaning means and at a location entirely behind the first primary cleaning means when the cleaning head is in the first position, and at a location entirely in front of the first primary cleaning means when the cleaning head is in the second position., whereby when the cleaning head is in the first position the longitudinally extending axis of the cleaning head is substantially parallel to the surface and when the cleaning head is in the second position, the longitudinally extending axis of the cleaning head is perpendicular to the surface.

18. The manual hand tool as in claim 17 further comprising locking means to secure the handle in relation to the first and second primary cleaning means.

19. The manual hand tool as in claim 18 wherein the locking means comprises a handle controlled lever mounted between the upper end of the handle and the cleaning head.

20. The manual hand tool as in claim 17 wherein the locking means comprises a cleaning head mounted clip.

21. The manual hand tool as in claim 17 wherein the pivotable means comprises a cradle mounted rotatable pin system.

22. The manual hand tool as in claim 17 wherein the first primary cleaning means is a first set of bristles forming a pushbroom and the second primary cleaning means is a second set of bristles forming a straightbroom.

23. The manual hand tool as in claim 17 wherein when the cleaning head is in the first position, the second primary cleaning means extends rearwardly of the handle.

24. The manual hand tool as in claim 23 wherein when the cleaning head is in the second primary position, the first primary cleaning means is located above the second primary cleaning means.

25. The manual hand tool as in claim 17 wherein when the cleaning head is in the second primary position, the first primary cleaning means is located above the second cleaning means.

* * * * *